United States Patent [19]

Turner et al.

[11] 3,949,575

[45] Apr. 13, 1976

[54] JET MACHINE AND PROCESSING METHOD

[75] Inventors: James Keith Turner, Lincolnton; William Cleere Sturkey, Charlotte, both of N.C.; Christopher W. Aurich, Clemson, S.C.

[73] Assignee: Gaston County Dyeing Machine Company, Mount Holly, N.C.

[22] Filed: July 17, 1974

[21] Appl. No.: 489,403

[52] U.S. Cl. ..... 68/5 C; 68/15; 68/20; 68/178

[51] Int. Cl.[2] ..... D06B 3/28

[58] Field of Search ..... 34/9, 36; 68/5 C, 6, 15, 68/19, 19.1, 20, 175, 177, 178, 179, 183

[56] References Cited

UNITED STATES PATENTS

| | | | |
|---|---|---|---|
| 1,403,126 | 1/1922 | Lyth | 68/179 X |
| 3,210,967 | 10/1965 | Schwab et al. | 68/15 X |
| 3,718,012 | 2/1973 | Vinas | 68/177 X |
| 3,762,866 | 10/1973 | Rayment et al. | 68/5 C X |
| 3,780,544 | 12/1973 | Turner et al. | 68/177 |

FOREIGN PATENTS OR APPLICATIONS

| | | | |
|---|---|---|---|
| 1,785,141 | 12/1972 | Germany | 68/177 |

*Primary Examiner*—Stanley N. Gilreath
*Assistant Examiner*—Philip R. Coe
*Attorney, Agent, or Firm*—Richards, Shefte & Pinckney

[57] ABSTRACT

A jet machine for wet processing textile fabric in continuous loop form is provided that is capable of applying dyestuff effectively from either a migrating or non-migrating system and that may be employed as well for bulking or shrinking prior to wet processing.

11 Claims, 4 Drawing Figures

JET MACHINE AND PROCESSING METHOD

CROSS-REFERENCES TO RELATED APPLICATIONS

None, except that copending application Ser. No. 489,404 filed July 17, 1974 discloses and claims procedure for prebulking or preshrinking that can be performed in apparatus such as the present application discloses, and copending application Ser. No. 389,268, filed July 20, 1973, also discloses apparatus that may be used for this purpose, the present application being directed to an improvement in the method and means of this prior application Ser. No. 381,268.

BACKGROUND OF THE INVENTION

Recent development work by others has produced several dyeing procedures in which exceptionally short liquor ratios are successfully employed. In general, the short liquor ratios involved (i.e., ratio of substrate weight to weight of treating liquor) are of the order at which no liquor exists outside the substrate upon application of the treating liquor thereto, so that the dyeing system involved is essentially a non-migrating one.

In providing apparatus and operating practice for practical application of these dyeing procedures to piece goods it has been found that because of the exceptionally short liquor ratios employed any dyestuff losses occurring during processing are apt to be significant and need to be prevented. The present invention provides an improved apparatus and processing method by which such losses are effectively prevented and which have proven equally effective for other purposes with great flexibility as noted further below.

SUMMARY OF THE INVENTION

Briefly characterized, the improved processing method of the present invention involves recirculating textile fabric (i.e., piece goods) in continuous loop form under an aspiration influence induced with an inert gas, while disposing a major portion of the fabric loop in a chamber capable of containing liquid and from which the loop is progressively withdrawn and then returned thereto during recirculation, and while drawing off the aspiration discharge adjacent the returning loop portion and delivering this discharge for inducing the aspiration influence.

Preferably, the liquid containing capability of the chamber provided for handling the recirculating fabric loop is made sufficient to accommodate a conventionally formulated dyestuff bath so that a migrating dyeing system can be employed at better than usual advantage as an alternative for any of the recently developed non-migrating systems. When this migrating system alternative is employed recirculation of the fabric loop under the aspirating influence causes the fabric to recirculate bath liquor as well so that level distribution is significantly promoted without the need for an external recirculating pump and piping system such as has heretofore been a common feature of jet machine arrangements. As a result, the quantity of bath liquor required is reduced materially to only that amount needed in the processing chamber for wetting the recirculating fabric loop thoroughly, which means that effective dyeing from a conventionally formulated bath is possible at a much shorter liquor ratio than is usual even though not as short as when a non-migrating system is employed.

The jet machine arrangement provided for wet processing in accordance with the present invention is characterized by a fabric loop chamber that is made capable of containing liquid by being sealed except for provision to allow the aspiration discharge to be drawn off and recycled. More particularly, the chamber in preferred form is spaced within a pressure kier in a J-box configuration with a throat formed adjacent the entrance to the J-box leg at which the fabric loop is returned and the aspiration discharge is drawn off through a connection at this throat that delivers externally of the kier and at the same time provides the only path of communication between the chamber and the enclosing kier as is noted further below.

The term "inert gas" is used in the foregoing summary, and in the more detailed description that follows, to mean that the gas employed to provide the aspirating influence is inert with respect to the fabric and any liquor being handled in the sense of having no unwanted reactive or other effect thereon. Normally the gas employed will be air, although one that is inert in the strict sense, such as nitrogen, can be used wherever there is reason to do so.

As to the migrating and non-migrating systems referred to, the difference may be generalized in usual terms on the basis of whether there is dyestuff movement (or migration) from one substrate area to another and, as suggested earlier this difference depends generally on whether or not liquor exists outside the substrate upon application of the dyestuff, although it appears there may be some exceptions to this rule. In quantitative terms, the non-migrating systems are those that can be successfully employed at liquor ratios in the order of 1:1.5, while use of a migrating system is uniquely possible according to the present invention at a liquor ratio in the order of 1:5, rather than the usually necessary ratio of about 1:10. In addition, the present invention provides capability for bulking or shrinking prior to wet processing and for wet processing other than dyeing, such as scouring, as stages in common of a fabric handling sequence.

DETAILED DESCRIPTION OF THE INVENTION

Figure 1:
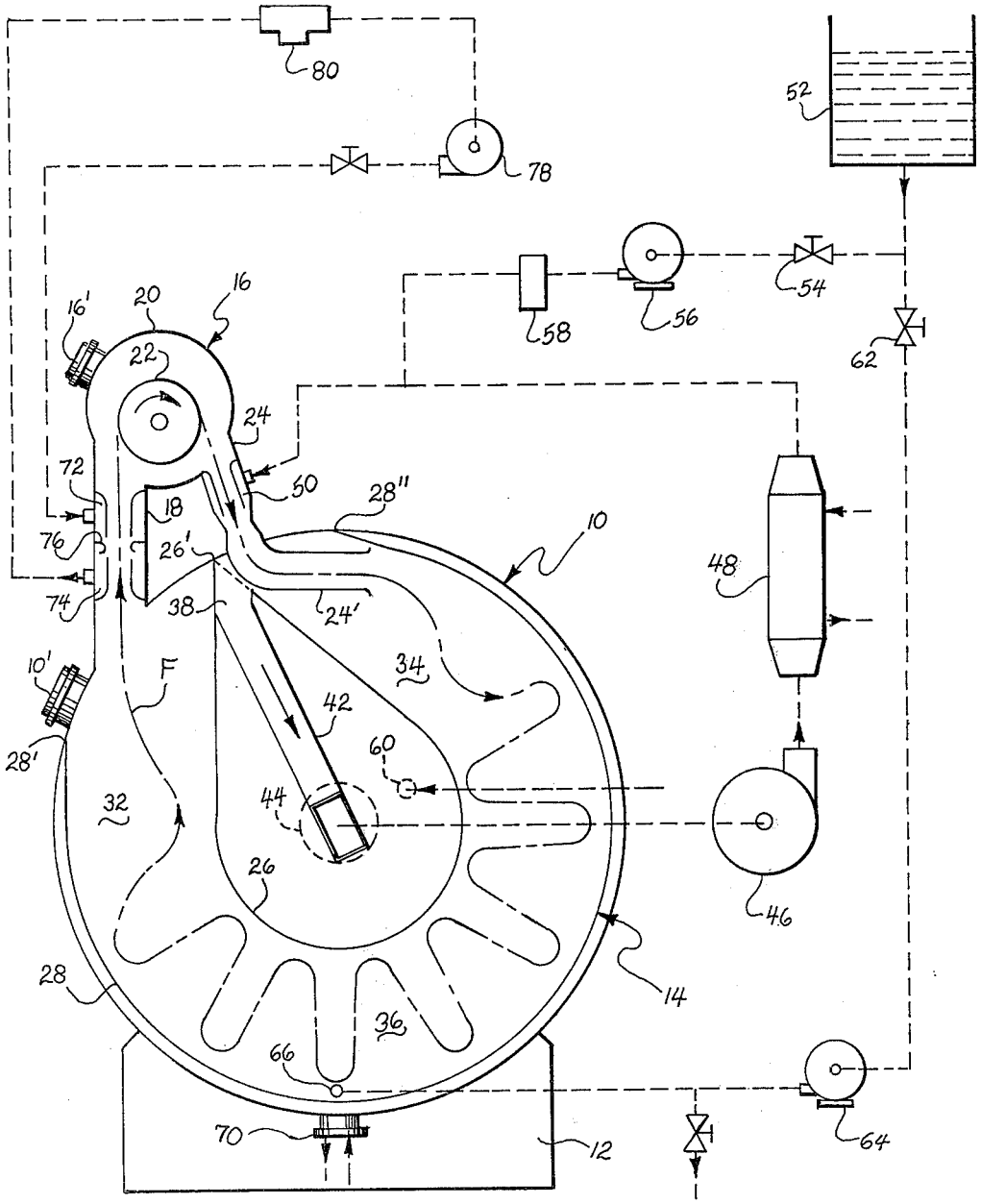
FIG. 1 is a schematic diagram of a processing system embodying the present invention.

FIG. 1 of the drawings diagrams a jet machine system corresponding largely with the one disclosed in the previously noted copending application Ser. No. 381,268 in that it includes a cylindrical pressure vessel or kier 10 mounted to stand with its axis horizontal on a suitable base 12 and having a fabric chamber 14 arranged therein, as well as having an external superstructure 16 fitted thereon in relation to the fabric chamber 14 for recirculation of a fabric loop F in the manner indicated.

As in application Ser. No. 381,268, the superstructure 16 is arranged with a vertical intake or entrance leg 18 rising above the outlet portion of chamber 14 for receiving the fabric loop F as it is withdrawn from the chamber, a junction housing 20 in which a driven lifter roll 22 is installed, and an inclined discharge leg 24 through which the recirculating fabric loop F is returned to fabric chamber 14 at a terminal fabric directing portion 24' extending horizontally within vessel 10. Also, as in the noted prior application, the entrance leg 18 of superstructure 16 is equipped with selectively operable extraction means, and the discharge leg 24 with means for inducing an aspiration influence with an inert gas in relation to which additional means is arranged for metering a treating liquor into the inert gas supply for application to the fabric when a short liquor ratio system of the non-migrating sort is being employed, all as will be described in greater detail further below.

A special arrangement of the fabric chamber 14 within vessel 10 is the central feature of improvement according to the present invention. The presently improved arrangement of fabric chamber 14 employs a J-box configuration for the chamber that is formed between imperforate inner and outer shells 26 and 28 and a pair of side walls 30 (compare FIG. 1 with FIGS. 2, 3, and 4). The J-box configuration provides a vertically rising chamber portion 32 from which the fabric loop F is progressively withdrawn during recirculation, an inclined chamber portion 34 at which the recirculating loop F is returned, and an arcuate chamber portion 36, in which a major portion of the fabric loop F is transiently stored during recirculation.

The chamber outer shell 28 is concentrically spaced within vessel 10 throughout its extent except at its end edges 28' and 28'' which terminate tangently formed shell portions and at which the shell is sealed by welding at the inner face of vessel 10. Outer shell 28 is also sealed by welding between the chamber side walls 30 throughout its extent, while the side walls 30 have an arcuate edge portion 30' at which they are welded to the inner face of chamber 10 throughout an extent exceeding the spacing between outer shell end edges 28' and 28'' so as to seal chamber 14 completely within vessel 10 insofar as its outer shell 28 is concerned. Beyond the arcuate edge portion 30' the periphery of chamber side walls 30 has spaced chordal segments removed therefrom, as indicated at 30'' in FIG. 4, so that communication is maintained with vessel 10 between the respective spaces at the outer faces of chamber side walls 30 and outer shell 28. If capacity for recirculating more than one fabric loop F is desired, the cylindrical axis of vessel 10 is simply extended enough to accommodate a corresponding multiple of the foregoing chamber structure together with the related inner chamber shell 26 to be described next.

Figure 2:
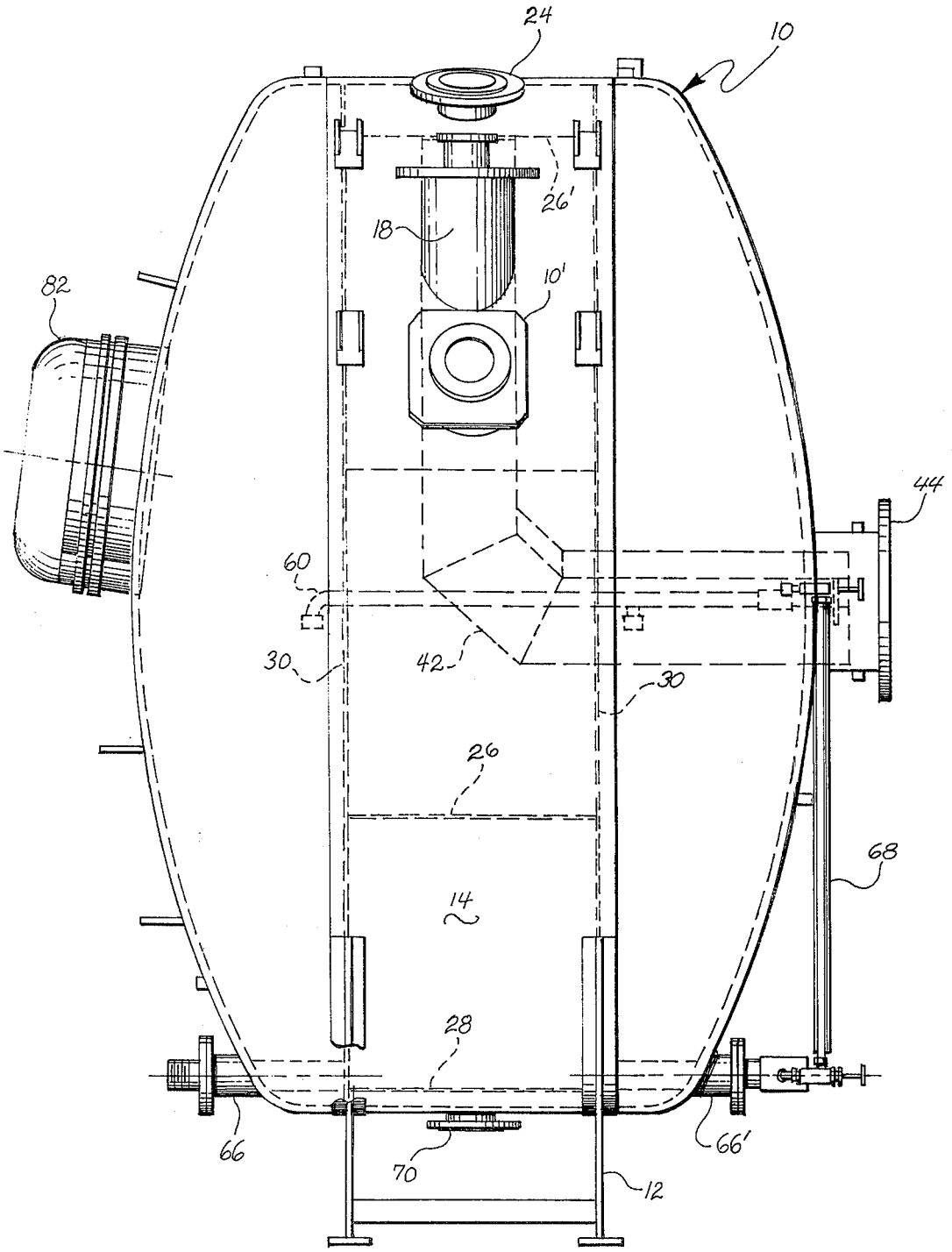
FIG. 2 is an elevation of a jet machine kier containing a fabric loop chamber arranged for processing according to the present invention.
Figure 3:
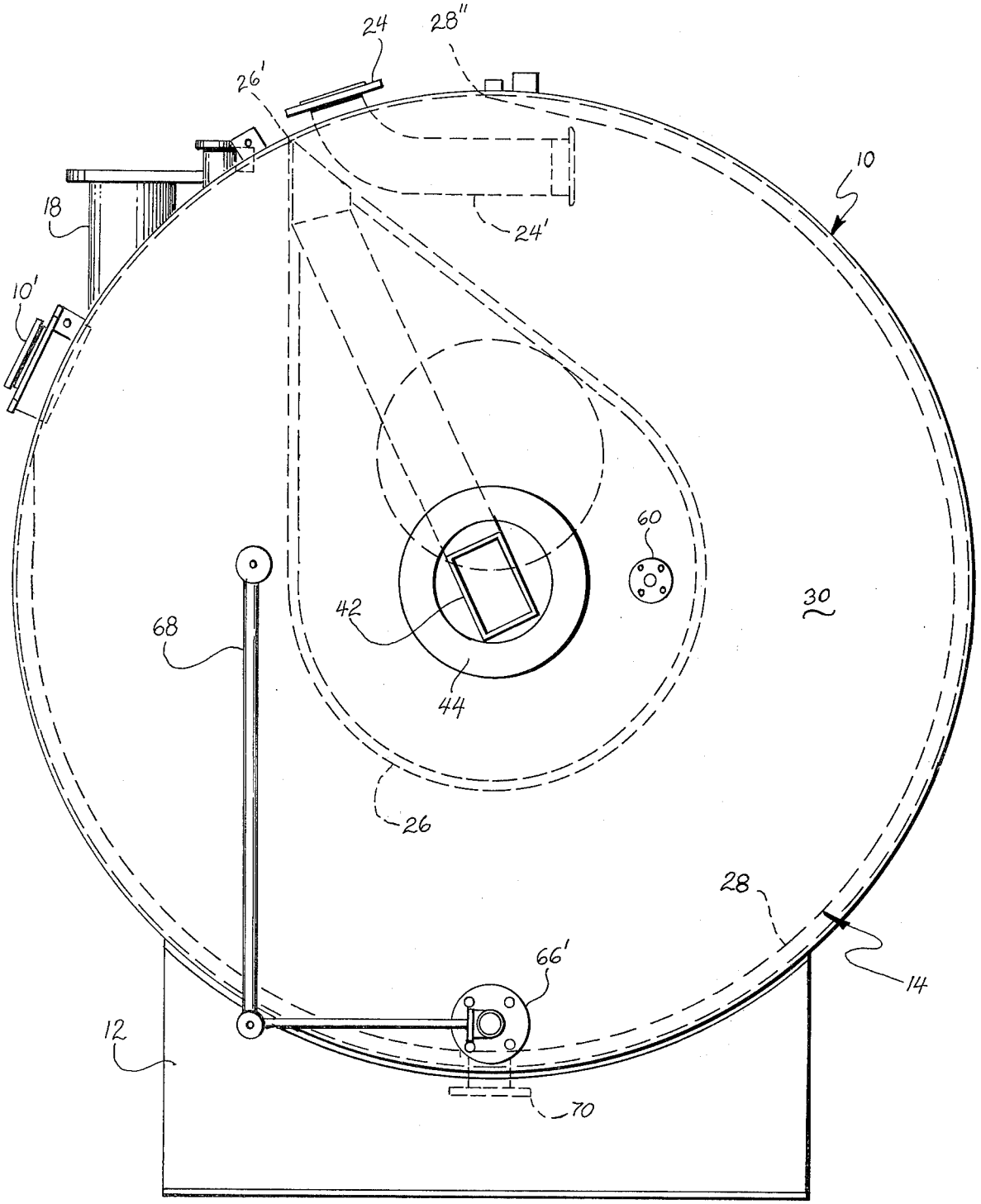
FIG. 3 is a further elevation as seen from the right in FIG. 2.
Figure 4:
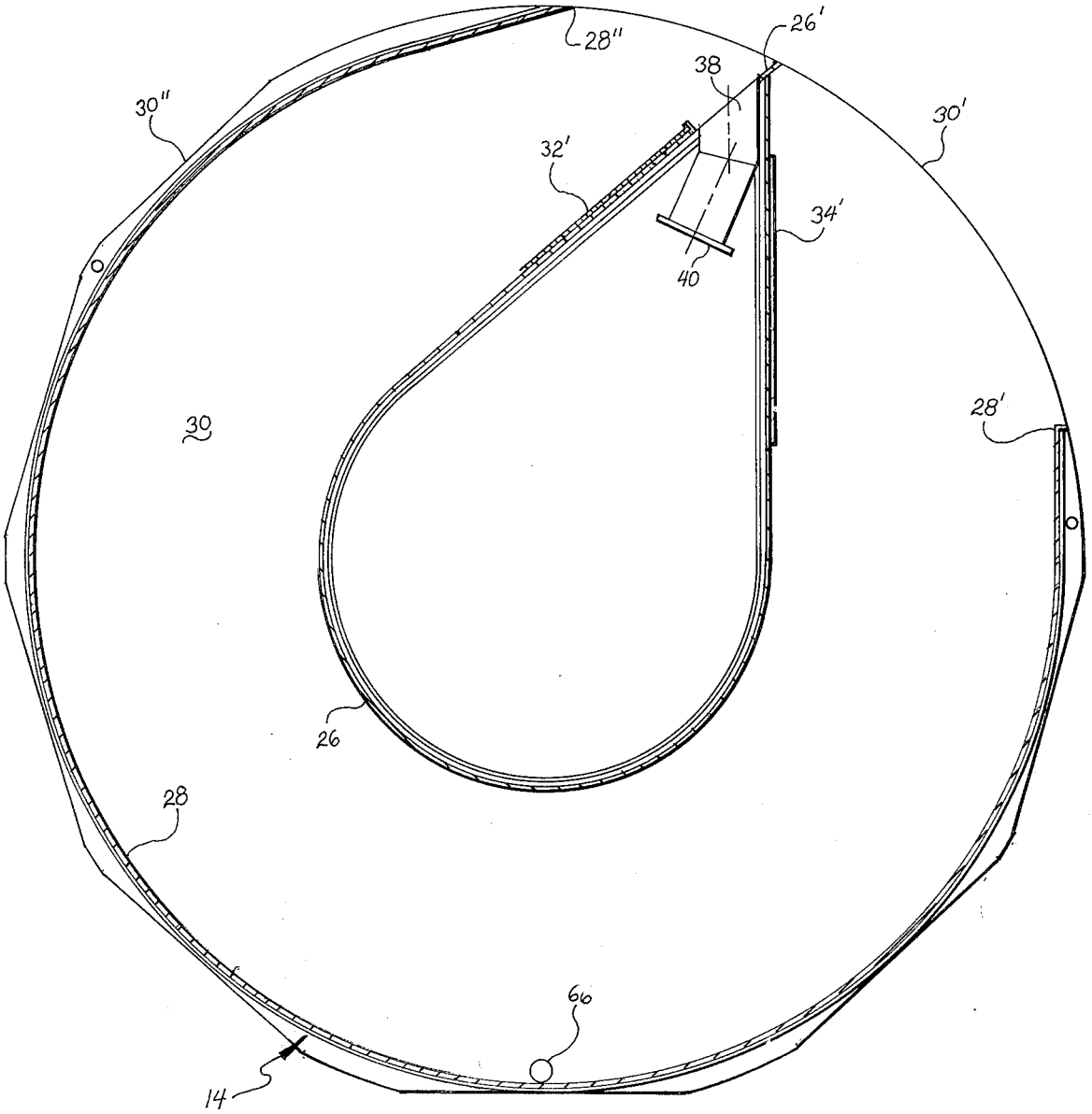
FIG. 4 is a side elevation detail of the fabric loop chamber contained within the jet machine kier.

The inner chamber shell 26 extends vertically at the exit chamber portion 32 and arcuately at the chamber storage portion 36 so as to maintain an essentially constant crosssectional area through both of these chamber portions, while extending at an inclination to meet its vertical portion in defining the inclined entrance portion 34 of chamber 14. Inner shell 26 is also sealed by welding between chamber side walls 30 and at the inner face of vessel 10 adjacent its meeting vertical and inclined portions, which are seen best in FIG. 4 at 26'. The inclined portion of inner shell 26 is also adjacently arranged to provide a throat 38 at which a fitting 40 is installed between the legs of chamber 14 (see FIG. 4) from which a duct 42 is connected to extend to a lateral outlet fitting 44 on vessel 10 as seen in FIGS. 2 and 3 and diagramed in FIG. 1. Both legs of inner shell 26 are additionally fitted with suitable sealed access doors 32' and 34' (see FIG. 4) opening to the chamber exit and entrance portions 32 and 34 for use whenever access thereto is needed.

The lateral outlet fitting 44 is provided on vessel 10 for connection thereat of the suction leg of a blower 46 (see FIG. 1) having a pressure leg that runs through a heat exchanger 48 to supply the inert gas by which aspiration is induced at a venturi 50 installed in the discharge leg 24 of superstructure 16. It should be noted that a terminal portion of duct 42 extends within outlet fitting 44 at a lesser cross-sectional area (compare FIGS. 2 and 3) so that fabric chamber 14 and the surrounding space within vessel 10 are in communication at, and only at, this point. Such communication provides for equalizing pressure inside and outside chamber 14 whenever vessel 10 is pressurized so that chamber 14 is not required to withstand pressure even though it is sealed within vessel 10 for the liquid containing capability that is needed for effective dyeing in accordance with the present invention.

The processing system of the present invention, as diagramed in FIG. 1, is arranged for applying either migrating or non-migrating dyestuff formulations as a matter of choice. For this purpose, an add tank 52, or a plurality of such tanks if desired, is provided from which either sort of formulation may be supplied. If a non-migrating system is being employed so that a dyestuff formulated at a short liquor ratio (i.e., in the order of 1:1.5) is to be applied, the formulated dyestuff supply is delivered through a valve 54, pump 56, and flow meter 58 for injection into the inert gas supply ahead of the venturi 50 at which the aspiration influence is imposed for recirculating the fabric loop F. This arrangement corresponds with that disclosed in the previously mentioned application Ser. No. 381,268, and allows excellent application and distribution of a short liquor ratio formulation.

In such a situation, however, it is important as noted earlier to avoid loss of dyestuff during the processing cycle. Dyestuff loss can occur, for example, by failure to control liquor displaced from the fabric through imposition of the aspiration influence, or in uncontrolled condensate formed from steam injected for heating purposes. If, as has commonly been the case in prior jet machine arrangements, the fabric chamber is merely arranged as perforate partitioning within the enclosing pressure vessel, or is otherwise incapable of containing liquid therein, the displaced dyestuff, or the dyestuff containing condensate, will simply drain to the bottom of the enclosing vessel and be lost to the dyeing system. The sealed fabric chamber arrangement of the present invention, however, results in either retaining the displaced dyestuff or condensate in chamber 14 where it will be picked up again by the recirculating fabric loop F, or in drawing off any such dyestuff or condensate that is entrained in the aspiration discharge and delivering it through duct 42 and blower 46 for reapplication to the fabric at the venturi 50.

In the foregoing connection, it also appears that the presently disclosed sealed chamber arrangement reduces materially the opportunity for condensate formation within the circuit through which fabric loop F is recirculated, because the steam injection for heating purposes is provided for by fitting the vessel 10 with injector means 60 extending between the legs of chamber 14 and discharging into the surrounding space within vessel 10 (compare FIGS. 1, 2 and 3) so that this space is used for heat exchange purposes. While this space is in communication with the chamber space at the end of duct 42 that delivers to the suction leg of blower 46, the blower suction will prefer to draw through duct 42 rather than from the chamber surrounding space within the enclosing vessel 10. Accordingly, when steam is injected within the vessel space, the heating effect produced is essentially by heat exchange through the walls of chamber 14 and, while some steam diffusion into the suction leg of blower 46 is possible, the situation is so different from the one obtained when the fabric loop F is recirculated in an atmosphere directly injected with steam that the objectionable effects encountered then with steam condensate are eliminated for all practical purposes by the chamber arrangement of the present invention.

If a migrating system is to be employed so that a conventionally formulated dyestuff liquor is to be applied, the delivery from add tank 52 is through a valve 62 and pump 64 to a fill and drain fitting 66 at the bottom of fabric chamber 14, which is also equipped with a comparable oppositely arranged fitting 66' for connection of a sight gauge 68 to indicate the liquid level in chamber 14. Under these circumstances, the chamber 14 is filled from add tank to a level sufficient for wetting the recirculating fabric loop F thoroughly, which will normally be a level at least approaching and preferably exceeding the vertical height of the chamber inner shell 26 above the outer shell 28 at the central section of vessel 10. With the conventionally formulated dyestuff bath thus disposed in chamber 14 application of the dyestuff is effected by recirculation of fabric loop F.

During such recirculation the fabric acts to recirculate dyestuff liquor as well without requiring a pump for this purpose, and the aspiration influence imposed at venturi 50 for fabric recirculation provides a significant leveling effect during the dyestuff application. Because the dyestuff application is effected entirely from a bath contained within chamber 14, and no handling of dyestuff liquor is required outside the circuit through which the fabric loop F is recirculated, the volume of formulated dyestuff required for effective application is reduced to such an extent that, as indicated earlier, operation at a liquor ratio in the order of 1:5 is feasible in contrast with a ratio around 1:10 commonly required by prior jet machine arrangements. Also, as when a non-migrating system is employed, the sealed arrangement of fabric chamber 14 prevents system liquor losses and even appears to enhance the results obtained by causing a recycling of liquor entrained with the aspiration discharge for reapplication at venturi 50, so that intentional bleeding of liquor into the recovered aspiration discharge or other delivery of a minor portion of the dyestuff bath to venturi 50 for application are potentially desirable although not an apparent necessity.

Typical operating procedure when employing a non-migrating system for dyestuff application involves loading the fabric to be processed, using the access ports 10' and 16' provided at vessel 10 and superstructure 16 as needed for this purpose, and with the driven lifter roll 22 and blower 46 running so as to form the fabric loop F and establish its recirculation. The dyestuff formulation is then injected into the inert gas supply ahead of venturi 50 at a metered rate selected to complete its addition in the course of about ten recirculating cycles of fabric loop F after which recirculation is continued for a comparable period to obtain through distribution of the applied dyestuff, all while operating temperature is maintained below that at which the dyestuff becomes substantive.

Upon application and distribution of the dyestuff in the foregoing manner it is caused to strike by elevating operating temperature to the extent needed for this purpose, and recirculation of the fabric loop F is continued at this temperature for an adequate fixing period. Operating temperature during the dyestuff application and distribution can be controlled satisfactorily by cooling at heat exchanger 48 to the extent needed for counteracting friction heat generated during operation of blower 46, while subsequent elevation to fixing temperature is effected by steam injection through the previously noted injector means 60 arranged within the vessel space surrounding fabric chamber 14. Additionally or alternatively, a drain fitting 70 on vessel 10, or other specially arranged fittings, can be employed to introduce or circulate heating or cooling fluid in this space for heat exchange influence on fabric chamber 14.

Following dye fixation and suitable cooling, the fabric loop F can be extracted through use of the previously mentioned means provided for this purpose in superstructure entrance leg 18. The extraction means provided as diagramed in FIG. 1 is of the sort disclosed in prior application Ser. No. 381,268, having upper and lower annular chambers 72 and 74 arranged above and below an annular dividing partition 76 so as to provide an outlet from the upper chamber 72 at partition 76 in the form of a jet orifice, and an intake spacing below partition 76 to lower chamber 74. Externally of superstructure entrance leg 18, the upper chamber 72 is connected with the pressure leg of an auxiliary blower 78 having its suction leg connected with lower chamber 74 through a water separator 80.

The jet orifice forming the outlet from upper chamber 72 is arranged so that operation of auxiliary blower 78 results in directing a jet of inert gas inwardly and oppositely with respect to the direction in which fabric loop F is recirculated, and this arrangement has the effect of displacing moisture in the fabric loop through penetration by the jet directed gas so as to generate a gas suspended extract continually as the loop F circulates. The auxiliary blower circuit also maintains a suction at lower chamber 74 that continually draws off this extract as it is formed. This extraction arrangement also makes it possible to rinse or wash or scour the fabric loop F during processing in vessel 10 by applying the treating liquor for such purposes either by injection ahead of venturi 50 or from a bath in vessel 10 and then extracting after treatment.

When a migratory system of dyestuff application is employed, typical operating procedure starts with filling the fabric chamber 14 with water to a suitable level and then loading the fabric and forming the loop F. If a prescouring is needed this may be done as a preliminary step. If not, the added water is adjusted to a suitable temperature within the range from about 100° to 140° F., and then after addition of the dyestuff and chemicals needed for the formulation being employed the fabric loop F is recirculated for about 5 to 10 minutes to apply and distribute the dyestuff before raising operating temperature sufficiently for fixation and continuing recirculation at the fixing temperature for a suitable period within the range of about 10 to 120 minutes as required by the particular material being handled and the dyestuff being used. Operating temperature is then reduced to approximately its initially adjusted level and is dropped to allow extraction of fabric loop F, after which one or more washing or scouring steps followed by extraction may be carried out before unloading the fabric.

It is also notable that the jet machine arrangement of the present invention can be employed for bulking or shrinking prior to wet processing in the manner disclosed and claimed in copending application Ser. No. 489,404. Ordinarily, it will probably not be desirable to occupy operating time for this purpose, because the bulking or shrinking can be accomplished effectively in much simpler equipment, as the copending application indicates, but the necessary heat treatment for this purpose can be applied just as effectively in the presently disclosed equipment and there may be instances when it would be desirable to do so therein as a preliminary step combined with subsequent wet processing.

The pressure vessel 10 is fitted with a manhole port at 82 (see FIGS. 2 and 3) for access to its interior, and it will be understood to be equipped with such gauges, safety vents, and other accessories as are needed and common in equipment of this sort. In particular, however, the sealed fabric chamber arrangement contained by vessel 10 according to the present invention should have final emphasis as its central feature of improvement that makes possible the exceptional operating flexibility it provides. While jet machine equipment is ordinarily arranged for handling a fabric loop F in rope form, as is the presently disclosed arrangement, the same operating principles can be applied for open width handling upon providing the obvious equipment adaptations needed for this purpose.

The present invention has been described in detail above for purposes of illustration only and is not intended to be limited by this description or otherwise to exclude any variation or equivalent form or procedure that would be apparent from, or reasonably suggested by, the foregoing disclosure to the skill of the art.

We claim:

1. Apparatus for wet processing textile fabric in continuous loop form of the type that includes means for recirculating said fabric loop free of nip constraint and under an aspiration influence induced with an inert gas, together with an enclosure housing a chamber of J-box configuration capable of containing liquid and arranged for storing a major portion of said fabric loop while the loop is progressively withdrawn from and returned to said chamber during recirculation under said aspiration influence, and in which said chamber is additionally arranged with a throat adjacent the entrance to the J-box leg at which the fabric loop is returned and means is connected at said throat for drawing off the discharge from said aspiration influence and delivering the drawn off discharge for inducing said aspiration influence, said connecting means providing the only path of communication between said chamber and the housing enclosure therefor.

2. Apparatus for wet processing textile fabric in continuous loop form as defined in claim 1 wherein the liquid containing capability of said chamber is sufficient to accommodate a conventionally formulated dyestuff bath.

3. Apparatus for wet processing textile fabric in continuous loop form as defined in claim 1 wherein said chamber is enclosed within a pressure kier.

4. Apparatus for wet processing textile fabric in continuous loop form as defined in claim 3 wherein said means for drawing off the aspiration discharge is a duct connected at said chamber throat and extending therefrom between the chamber J-box legs to a lateral opening in the enclosing pressure kier at which the suction leg of a blower included in said recirculating means is connected in communication with both said pressure kier and said duct.

5. Apparatus for wet processing textile fabric in continuous loop form as defined in claim 4 wherein said recirculating means also includes a venturi at which the pressure leg of said blower is connected for inducing an aspiration influence thereat.

6. Apparatus for wet processing textile fabric in continuous loop form as defined in claim 5 wherein a conduit superstructure is assembled with said kier and includes an entrance leg for receiving said fabric loop upon withdrawal from said chamber and a discharge leg for directing return of the loop to said chamber, and wherein said venturi is installed in said discharge leg.

7. Apparatus for wet processing textile fabric in continuous loop form as defined in claim 6 wherein said superstructure entrance leg is equipped with extraction means operable selectively for receiving liquid from said fabric loop during recirculation.

8. Apparatus for wet processing textile fabric in continuous loop form as defined in claim 3 wherein said kier is fitted with means to employ the space therein around said chamber for heat exchange purposes to control the temperature of said fabric loop during recirculation.

9. Apparatus for wet processing textile fabric in continuous loop form as defined in claim 8 wherein the means to employ said kier space for heat exchange purposes is a steam injector.

10. Apparatus for wet processing textile fabric in continuous loop form as defined in claim 1 wherein means is provided for injecting dyestuff into the inert gas by which said aspiration influence is induced so that the dyestuff is applied to said fabric incident to said aspiration influence.

11. Apparatus for wet processing textile fabric in continuous loop form as defined in claim 1 wherein said chamber is fitted with means for disposing a dyestuff bath in said chamber for application to said fabric during recirculation under said aspiration influence.

* * * * *